US005785423A

United States Patent [19]

Chikami

[11] Patent Number: 5,785,423

[45] Date of Patent: Jul. 28, 1998

[54] CONTINUOUS EMULSIFICATION TANK AND PROCESS

[75] Inventor: Nozomu Chikami, Shizuoka, Japan

[73] Assignee: Fuji Photo Film Co., Ltd., Kanagawa, Japan

[21] Appl. No.: 684,141

[22] Filed: Jul. 19, 1996

[30] Foreign Application Priority Data

Jul. 20, 1995 [JP] Japan ..... 7-183853

[51] Int. Cl.[6] ..... B01F 15/02

[52] U.S. Cl. ..... 366/165.3; 366/150.1

[58] Field of Search ..... 366/150.1, 154.1, 366/165.1, 165.3, 165.4, 166.1, 167.1, 168.1, 181.8, 182.2, 184, 194; 149/109.6

[56] References Cited

U.S. PATENT DOCUMENTS

| | | | |
|---|---|---|---|
| 3,973,759 | 8/1976 | Mizrahi et al. . | |
| 4,911,770 | 3/1990 | Oliver et al. | 149/109.6 |
| 5,192,130 | 3/1993 | Endo et al. | 266/155.1 |

FOREIGN PATENT DOCUMENTS

| | | |
|---|---|---|
| 0403091 | 12/1990 | European Pat. Off. . |
| 0535384A1 | 9/1992 | European Pat. Off. . |
| 2509996 | 1/1983 | France . |
| 3227884A1 | 2/1983 | Germany . |

OTHER PUBLICATIONS

Chemie-Ingenieur-Technik, vol. 53, No. 8, 1981, Weinheim, pp. 641-647 XP002017004; B. Koglin et al. "kontinuierliches emulgieren mit rotor/stator-maschinen: einfluss der volumenbezogen dispergierleistung und der verweilziet auf die emulsionsfeinheit".

Database WPI Week 9201, Derwent Publications Ltd., London, GB; AN 92004264; XP002017005 & JP-A-03 258 332 (Konica Corp), 18 Nov. 1991.

*Primary Examiner*—Tony G. Soohoo

*Attorney, Agent, or Firm*—Sughrue, Mion, Zinn, Macpeak & Seas, PLLC

[57] ABSTRACT

The continuous emulsification tank of the invention is provided with a feed port of an oil phase solution and the continuous emulsification method uses the tank. By constituting the tank as above, continuous emulsification is possible for a long time without clogging by the deposition of solid material on the inside wall of pipes and apparatuses.

8 Claims, 2 Drawing Sheets

CONTINUOUS EMULSIFICATION TANK AND PROCESS

BACKGROUND OF THE INVENTION

This invention relates to a continuous emulsification tank for the production of an oil-in-water type emulsion from an oil phase solution containing at least a polyvalent isocyanate and a water phase solution.

Preparation of oil-in-water type emulsion by adding an oil phase solution containing a solute which becomes core material and a polyvalent isocyanate to a water phase solution followed by agitating is widely utilized in the production of pressure-sensitive papers, photographic photosensitive materials, cosmetics, paints, etc. In most of the preparations, an oil phase solution containing a core material is prepared, and a polyvalent isocyanate is added thereto. The oil phase solution is then emulsified in a water phase solution resulting in the occurence of reaction of the polyvalent isocyanate with amine, polyol or the like to form microcapsules with urethane or polyurea membrane.

In every conventional emulsification, a polyvalent isocyanate is added to an oil phase solution containing a core material, further mixed with a water phase solution, and emulsified continuously in an emulsification tank, a pipe line homomixer or the like (U.S. Pat. No. 5,192,130, U.S. Pat. No. 5,401,443 and Japanese Patent KOKAI 3-258332).

A conventional apparatus is illustrated in FIG. 4. In the apparatus, an oil phase solution 1 wherein a solute has previously been dissolved, a polyvalent isocyanate 4 and a water phase solution 7 are stored in tanks 2, 5, 8, respectively. The polyvalent isocyanate 4 is fed quantitatively by a volumetric pump 6, and added continuously in a pipe to the oil phase solution which is fed similarly by a volumetric pump 3, and mixed by a continuous mixer 10. Subsequently, the water phase solution 7 fed by a volumetric pump 9 is added continuously in a pipe, and fed to an emulsification tank 11. The feeding position of the above mixture is the upper side (Japanese Patent KOKAI 3-258332) or bottom (U.S. Pat. No. 5,401,443) of the emulsification tank.

Incidentally, when an oil phase solution contains polyvalent isocyanate, feeding manner of the oil phase solution and water phase solution to a continuous emulsification tank is important in view of stabilization of manufacturing process. In the prior art, the oil phase solution joins with a water phase solution in a pipe on the upstream of a continuous emulsion tank, and deposition at the joining point is a problem, because of clogging in a short period operation. As a result, overhaul of the pipeline with stopping the production was necessary frequently degrade production efficiency.

SUMMARY OF THE INVENTION

An object of the invention is to provide an emulsification tank which can be operated for a long period without clogging troubles by a reaction product upon preparation of oil-in-water type emulsion from an oil phase solution containing a polyvalent isocyanate and a water phase solution.

Another object of the invention is to provide a continuous emulsification method which can also be operated for a long period without clogging troubles by a reaction product upon preparation of oil-in-water type emulsion from an oil phase solution containing a polyvalent isocyanate and a water phase solution.

The inventors investigated eagerly in order to resolve the above problem, and found that, polyurea resin produced by the reaction of the polyvalent isocyanate in the oil phase solution with water in the water phase solution was adhered to inner wall of pipe at a position where an interface between the oil phase solution and the water phase solution contacts, and the deposits grows finally to clog the pipe at the joining point.

The present invention provides an emulsification tank, which has achieved the above object, which is provided a continuous emulsification tank provided with a feed port of an oil phase solution containing a polyvalent isocyanate at bottom of the tank, a water phase solution feed port on lower side on the tank, and an emulsion discharge port on upper part of the tank, and include a mixing blade.

The present invention also provides an emulsification process, which has achieved the above object, which utilizes the continuous emulsification tank wherein said mixing blade is propeller blade, edged turbine or the like.

| | |
|---|---|
| 1 | Oil phase solution |
| 2, 5, 8 | Storage tank |
| 3, 6, 9 | Volumetric pump |
| 4 | Polyvalent isocyanate |
| 7 | Water phase solution |
| 10 | Continuous mixer |
| 11 | Continuous emulsification tank |

DETAILED DESCRIPTION OF THE INVENTION

Figure 1:
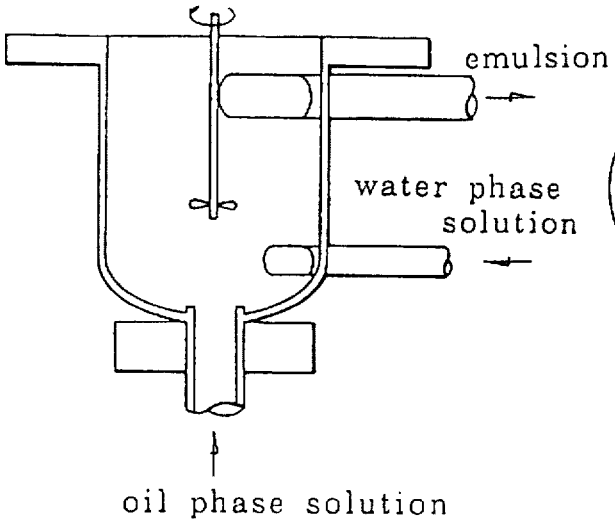
FIG. 1 is a schematic sectional side view of a continuous emulsification tank which embodies the invention.
Figure 2:
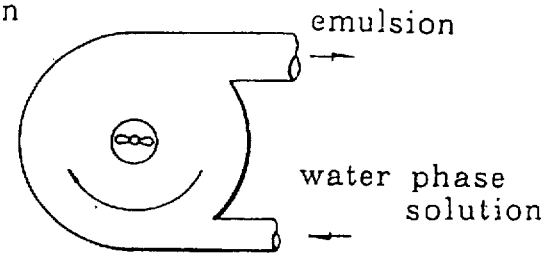
FIG. 2 is a transverse section thereof.
Figure 3:
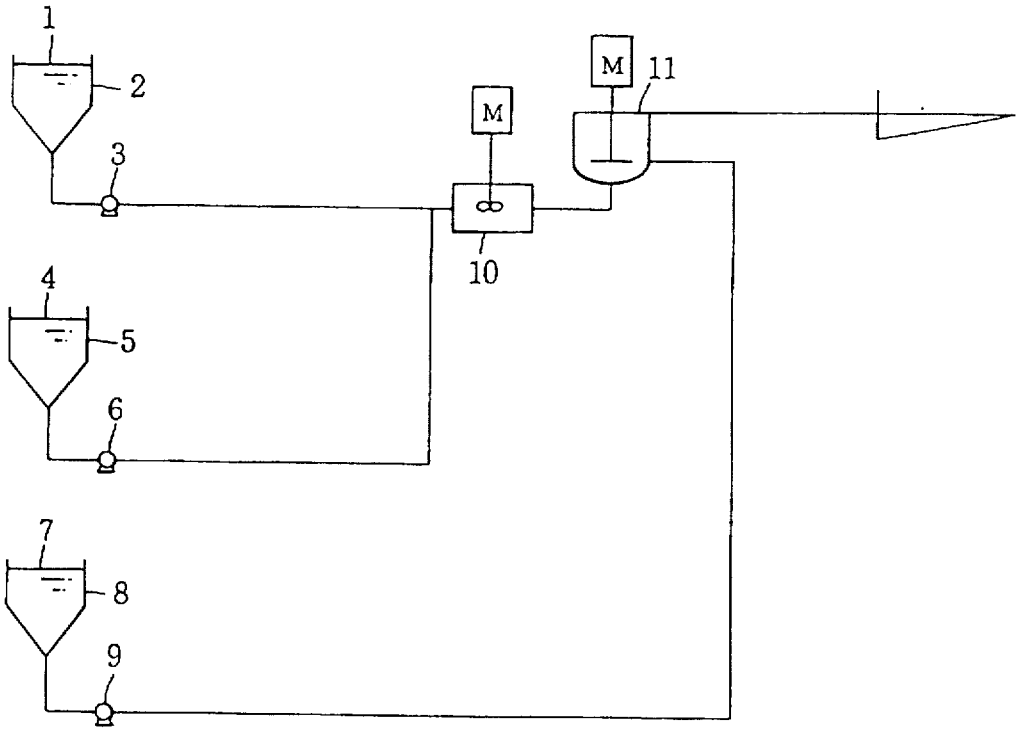
FIG. 3 is a flow diagram of a continuous emulsification apparatus used in examples of the invention.

FIGS. 1 and 2 are schematic illustrations of an emulsification tank according to the invention, and FIG. 3 illustrates a flow diagram of an emulsification apparatus into which the emulsification tank is incorporated. In FIG. 3, various attachment devices, such as valves, flowmeters and the like are not illustrated.

An oil phase solution 1 wherein a solute has been dissolved previously, a polyvalent isocyanate 4 and a water phase solution 7 are stored in tanks 2, 5, 8, respectively.

Although not illustrated, each of the tanks 2, 5, 8 may be provided with a stirrer, a temperature controller, an automatic liquid supplier for regulating liquid level constant or the like.

Polyvalent isocyanate 4 and a water phase solution 7 are stored in tanks 2, 5, 8, respectively. The polyvalent isocyanate 4 is fed quantitatively by a volumetric pump 6, and added continuously in a pipe to the oil phase solution which is fed similarly by a volumetric pump 3. Then, the oil phase solution is fed into the emulsification tank 11 from the lowermost position. The volumetric pumps have metering ability, and illustrative of them are gear pump, plunger pump, motor pump, diaphragm pump, and the like. In order to improve homogeneity of the oil phase solution containing polyvalent isocyanate, a continuous mixer 10 may be incorporated. Illustrative of the mixers 10 are in-line mixers, such as static mixer and high shearing mixer, pipeline homomixer, homomix line flow, and the like.

On the other hand, the water phase solution 7 is delivered quantitatively by a volumetric pump 9, and fed into the emulsification tank 11 from the lower side in the tangential direction which conforms with the flow direction generated by the rotation of a stirrer provided in the emulsification tank 11. In order to achieve the emulsification operation it is better to select the feed point of the water phase solution at lower side of the mixing blade.

The emulsification tank 11 may be provided with baffle members. The stirring blade may be in a form of propeller blade, turbine blade, or the like, and the stirring blade may be doubled or more.

The oil phase solution contains a solute which is in accordance with the object of use of emulsion. Illustrative of the solutes are various basic colorless dyes used for capsules in pressure-sensitive copying papers, and various materials in accordance with the use of capsules, such as various other recording materials, medicines, perfumes, agricultural chemicals, chemical conversions, adhesives, liquid crystals, paints, foods, detergents, solvents, catalysts, enzymes, anti-rust agents, etc. Exemplary of the basic colorless dyes are triarylmethane-based compounds such as Crystal Violet lactone, 8,8-bis (p-dimethylaminophenyl) phthalide and 3-(p-dimethylaminophenyl)-3-(1,2-dimethylindole-3-yl) phthalide, dephenylmethane-based compounds, such as 4,4'-bis-dimethylaminobenzhydryl benzyl ether, N-halophenylleucoauramine and N-2,4,5-trichlorophenylleucoauramine, xanthene-based compounds, such as Rhodamine B-anilinolactum, 3-diethylamino-7-chlorofluoran, 3-diethylamino-6,8-dimethylfluoran, 8,7-diethylaminofluoran and 3-diethylamino-7-chloroethylmethyla minofluoran, thiazine-based compounds, such as Benzoylleucomethylene Blue and p-Nitrobenzylleucomethylene Blue, spiro compounds, such as 3-methyl-spiro-dinaphthopyran, 3-ethyl-spiro-dinaphthopyran and 3-propyl-spiro-dibenzopyran, and the like, and combinations thereof.

Suitable oil substances composition the oil phase solution are various animal oils, such as fish oils and lard, vegetable oils, such as castor oil and soybean oil, mineral oils, such as Kerosene and naphtha, synthetic oils, such as alkylated naphthalenes, alkylated biphenyls, hydrogenated terphenyls, alkylated diphenylmethanes and alkylated benzenes, and the like, and combinations thereof.

The polyvalent isocyanate applicable to the invention includes various diisocyanates, such as m-phenylene diisocyanate, p-phenylene diisocyanate, 2,6-tolylene diisocyanate, 2,4-tolylene diisocyanate, naphthalene-1,4-diisocyanate, diphenylmethane-4,4'-diisocyanate, 3,3'-dimethyldiphenylmethane-4,4'-diisocyanate, xylylene-1,4-diisocyanate, xylylene-1,3-diisocyanate, 4,4'-diphenylpropane diisocyanate, trimethylene diisocyanate, hexamethylene diisocyanate, propylene-1,2-diisocyanate, butylene-1,2-diisocyanate, ethylidyne diisocyanate, cyclohexylene-1,2- diisocyanate and cyclohexylene-1,4-diisocyanate, triisocyanates, such as 4,4',4"-triphenylmethane triisocyanate and toluene-2,4,6-triisocyanate, tetraisocyanates, such as 4,4'-dimethyldiphenylmethane-2,2',5,5'-tetraisocyanate, and the like. In the case that the polyvalent isocyanate is solid, the isocyanate is dissolved in a solvent, such as acetone, tetrahydrofuran, dimethylformamide, ethyl acetate, butyl acetate, dimethyl phthalate, dibutyl phthalate or dioctyl phthalate or a mixture of two or more of them, prior to use. Optionally, the polyvalent isocyanate has been dissolved in the aforementioned oil substance.

It is preferable to add an emulsifier to the water phase solution. Suitable emulsifiers include natural or synthetic hydrophilic polymer protective colloids, such as gelatin, gum arabic, casein, carboxymethyl cellulose, starch and polyvinyl alcohol, anionic surfactants, such as alkylbenzene sulfonate, alkylnaphthalene sulfonate, polyoxyethylene sulfate and Turkey red oil, nonionic surfactants, such as polyoxyethylene alkyl ether, polyoxyethylene alkylphenol ether and sorbitan fatty acid ester, and the like.

The mixing ratio of the oil phase solution to the water phase solution is adjusted according to materials to be used, object of capsules, or the like within the range of not phase inversion, i.e. of forming oil-in-water type emulsion. In general, the ratio is 45 to 95% by weight, particularly 45 to 55% by weight of water phase solution, i. e. 55 to 5% by weight, particularly 55 to 45% by weight of oil phase solution.

When the emulsion is made microcapsules, a polyvalent amine, a polyvalent carboxylic acid, a polyvalent thiol, a polyvalent hydroxyl compound, an epoxy compound or the like is added. Illustrative of the polyvalent amines are polyvalent aromatic amines, such as o-phenylenediamines, p-phenylenediamine and 1,5-diaminonaphthalene, polyvalent aliphatic amines, such as 1,3-propylenediamine, 1,4-butylenediamine and hexamethylenediamine, etc. Illustrative of the polyvalent carboxylic acids are pimelic acid, suberic acid, azelaic acid, sebacic acid, phthalic acid, terephthalic acid, 4,4'-biphenyl-dicarboxylic acid and 4,4'-sulfonyldibenzoic acid, etc. Illustrative of the polyvalent thiols are condensates of thioglycol and reaction products of polyvalent alcohol with a suitable thioether glycol, etc. Illustrative of the polyvalent hydroxyl compounds are polyvalent aliphatic alcohols, polyvalent aromatic alcohols, hydroxypolyesters and hydroxypolypropylene ethers, etc. Illustrative of the epoxy compounds are aliphatic glycidyl ethers, such as diglycidyl ether, aliphatic glycidyl esters, etc.

EXAMPLES

Example 1

The apparatus shown in FIGS. 1–3 was used.

The oil phase solution was prepared by dissolving 10 parts by weight of Crystal Violet lactone, 1 part by weight of Benzoylleucomethylene Blue and 4 parts by weight of 3-[4-(diethylamino)-2-ethoxyphenyl]-3-(2-methyl-1-ethyl-3-indolyl)-4-azaphthalide as coloring agents into 200 parts by weight of diisopropylnaphthalene, and stored in a storage tank 2 at 65° C.

As the polyvalent isocyanate, buret form of hexamethylene diisocyanate ("Sumijule N 3200", Sumitomo Bayer Urethane Co., Ltd.) was stored in a storage tank 5 at room temperature.

The water phase solution was prepared by dissolving 15 parts by weight of polyvinyl alcohol ("PVA 205", Kuraray Co., Ltd.) as protective colloid in emulsification into 135 parts by weight of water, and stored in a storage tank 8 at 65° C.

Although not illustrated, respective storage tanks 2, 5, 8 were provided with an automatic liquid supply system for maintaining liquid level constant.

Hereupon, using a volumetric pump 3, 6, the oil phase solution was fed at a speed of 45 parts by weight/minute, and the polyuvalent isocyanate was fed at a speed of 5 parts by weight/minute. They were mixed continuously by a continuous mixer 10, and supplied into a continuous emulsification tank 11 from the bottom.

The water phase solution was fed at a speed of 50 parts by weight/minute from the lower side in the tangential direction which conformed with the flow direction generated by the stirren in the tank.

As a result, clogging did not occur in pipes and apparatuses at all through continuous operation of 500 hours. Moreover, foreign matter was not adhered to the inside of the continuous emulsification tank 11 throughout the operation.

Comparative Example 1

Figure 4:
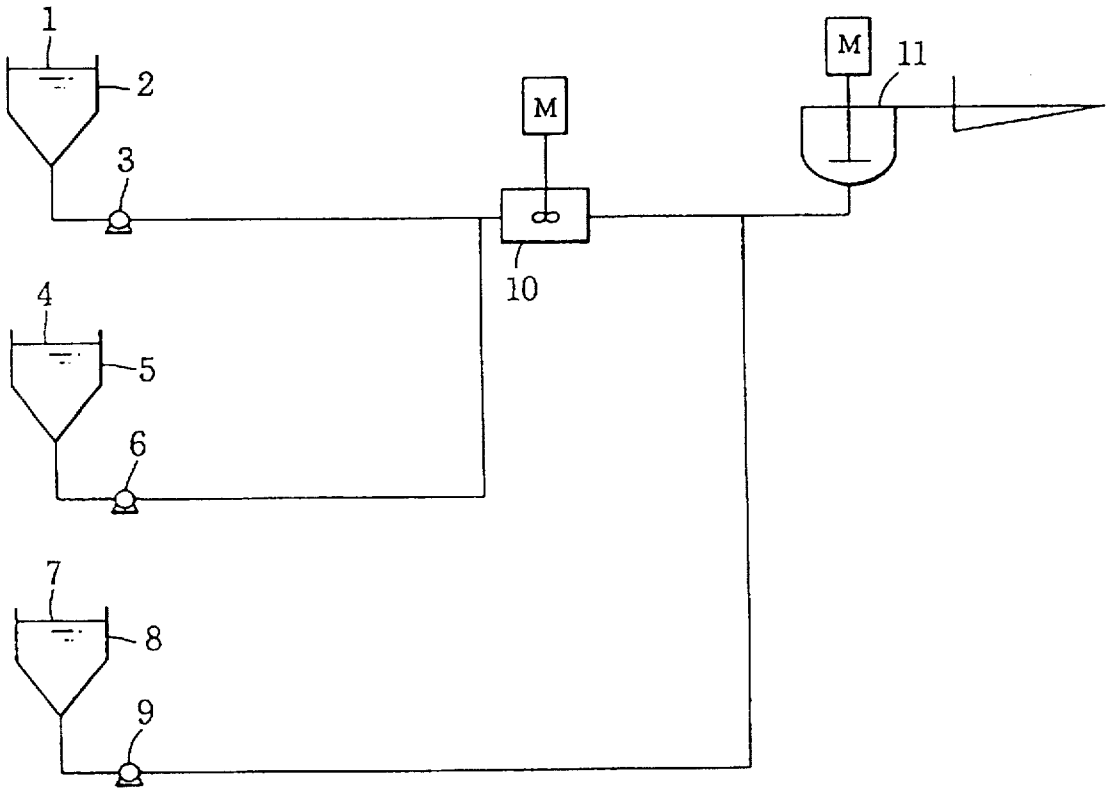
FIG. 4 PRIOR ART
FIG. 4 is a flow diagram of a conventional continuous emulsification apparatus.

The apparatus shown in FIG. 4 was used. The same oil phase solution, polyvalent isocyanate and water phase solution as Example 1 were used, and fed at the same speed as Example 1.

As a result, the joining point of the oil phase solution with the water phase solution was almost clogged after about 40 hours from the start.

Example 2

The apparatus shown in FIGS. 1–3 was used, and the same oil phase solution, polyvalent isocyanate and water phase solution were fed in the same manner as Example 1, except that their feeding speed was changed, i.e. the oil phase solution was fed at a speed of 47 parts by weight/minute, the polyvalent isocyanate was fed at a speed of 3 parts by weight/minute, and the water phase solution was fed at a speed of 50 parts by weight/minute.

As a result, clogging and its symptom did not occur in pipes and apparatuses through continuous operation of 500 hours.

As described in the example, the present invention provides method and apparatus capable of operation for a long period without clogging troubles by a reaction product upon preparation of oil-in-water type emulsion from an oil phase solution containing a polyvalent isocyanate and water phase solution.

It should also be understood that the foregoing relates to only a preferred embodiment of the invention, and that it is intended to cover all changes and modifications of the examples of the invention herein chosen for the purposes of the disclosure, which do not constitute departures from the spirit and scope of the invention.

I claim:

1. A continuous emulsification process which comprises feeding an oil phase solution containing a polyvalent isocyanate continuously from the bottom of an emulsification tank, feeding a water phase solution continuously from the lower side of the emulsification tank in the liquid flow direction generated by rotation of a stirrer, and discharging an emulsion from the emulsion tank continuously.

2. A continuous emulsification process as claimed in claim 1, wherein the polyvalent isocyanate is fed by a volumetric pump and added continuously in a pipe to the oil phase solution which is fed similarly by a volumetric pump, before said feeding of said oil phase solution containing said polyvalent isocyanate to said emulsion tank.

3. A continuous emulsification process as claimed in claim 2, wherein the polyvalent isocyanate is added to the oil phase solution by a mixer.

4. A continuous emulsification process as claimed in claim 3, wherein the water phase solution is fed by a volumetric pump.

5. A continuous emulsification process as claimed in claim 4, wherein the feeding direction of the water phase solution is in the tangential direction of the emulsification tank.

6. A continuous emulsification process as claimed in claim 1, wherein the polyvalent isocyanate is reactive with water.

7. A continuous emulsification process as claimed in claim 1, wherein the polyvalent isocyanate is selected from the group consisting of m-phenylene diisocyanate, p-phenylene diisocyanate, 2,6-tolylene diisocyanate, 2,4-tolylene diisocyanate, naphthalene-1,4-diisocyanate, diphenylmethane-4,4'-diisocyanate, 3,3'-dimethyldiphenylmethane-4,4'-diisocyanate, xylylene-1,4-diisocyanate, xylylene-1,3-diisocyanate, 4,4'-diphenylpropane diisocyanate, trimethylene diisocyanate, hexamethylene diisocyanate, propylene-1,2-diisocyanate, butylene-1,2-diisocyanate, ethylidyne diisocyanate, cyclohexylene-1,2-diisocyanate, cyclohexylene-1,4-diisocyanate, 4,4',4"-triphenylmethane triisocyanate, toluene-2,4,6-triisocyanate, and 4,4'-dimethyldiphenylmethane-2,2',5,5'-tetraisocyanate.

8. A continuous emulsification process as claimed in claim 1, wherein the polyvalent isocyanate is selected from the group consisting of diisocyanates, triisocyanates, and tetraiisocyanates.

* * * * *